US006357761B1

(12) United States Patent
Peng et al.

(10) Patent No.: US 6,357,761 B1
(45) Date of Patent: Mar. 19, 2002

(54) LIQUID INSULATION FOR EQUIPMENT

(75) Inventors: Jui-Hung Peng; Rong-Ching Wu, both of Hsinchu (TW)

(73) Assignee: Winbond Electronics Corporation, Hsinchu (TW)

( * ) Notice: Subject to any disclaimer, the term of this patent is extended or adjusted under 35 U.S.C. 154(b) by 0 days.

(21) Appl. No.: 09/495,617

(22) Filed: Feb. 1, 2000

(30) Foreign Application Priority Data

Sep. 14, 1999 (TW) ..... 88215748 U

(51) Int. Cl.[7] ..... F16L 5/02; B65D 63/00

(52) U.S. Cl. ..... 277/607; 24/16 PB; 245/3; 474/101; 174/137 R

(58) Field of Search ..... 277/607; 24/16 PB; 245/3; 474/101; 174/137 R

(56) References Cited

U.S. PATENT DOCUMENTS 3,672,003 A * 6/1972 Morgan ..... 24/16 PB
4,041,241 A * 8/1977 Olmstead ..... 174/153
5,836,053 A * 11/1998 Davignon ..... 24/16 PB
6,111,194 A * 8/2000 Kroulik ..... 174/47

* cited by examiner

*Primary Examiner*—Anthony Knight
*Assistant Examiner*—Matthew E. Rodgers

(57) ABSTRACT

A method and a device for preventing seeping liquid from entering equipment along a connecting line such as an electrical line or a pipe line are disclosed. The method is performed by using a liquid-insulating device surrounding a section of the connecting line to stop the liquid from crossing thereover to reach the equipment. The liquid-insulating device is made of a liquid-proof material, and preferably includes a guiding member to guide the liquid stopped thereby to flow away from the connecting line.

22 Claims, 5 Drawing Sheets

LIQUID INSULATION FOR EQUIPMENT

FIELD OF THE INVENTION

The present invention is related to insulating means for preventing liquid from seeping into equipment, and more particularly to a liquid-insulating device used for protecting electrical apparatus from damage by corrosion of seeping liquid.

BACKGROUND OF THE INVENTION

For automation in industries, it is general to locate various liquid pipes around electrical equipment to directly apply liquid to the process. Especially for the fabrication of semiconductor devices, the piping and the machine are even combined as a whole. Under the circumstances, it is possible for the liquid carried by the pipes to seep through the pipe walls, drop onto the surface of a cable, and flow into an electronic part of the equipment, e.g. a connector, along the cable. Therefore, the electronic part may become short-circuit owing to the presence of the liquid. In particular, the liquid used in the semiconductor manufacturing process is generally corrosive to electronic elements so as to enlarge the problem, and even to render the machine down.

SUMMARY OF THE INVENTION

Therefore, an object of the present invention is to provide a liquid-insulating device which can be mounted to a connecting line of equipment to protect the equipment from the contamination of the seeping liquid so as to avoid malfunction of the equipment resulting from the presence of the seeping liquid Another object of the present invention is to provide a method for protecting equipment from the damage of the seeping liquid by providing a liquid-proof sleeve therefor.

Another object of the present invention is to provide a device for protecting equipment from the damage of the seeping liquid, which includes a plurality of liquid-proof sleeves and a liquid-proof wrapper.

A further object of the present invention is to further guide the liquid away in addition to stopping the liquid from entering the equipment.

According to a first aspect of the present invention, a liquid-insulating device is provided to be mounted around an electrical line of equipment to avoid liquid entering the equipment along the electrical line. The liquid-insulating device includes a surrounding portion and a guiding portion. The surrounding portion is made of a liquid-proof material, e.g. rubber, to be mounted around a wire wrapper of the electrical line to stop the liquid from flowing to the equipment therethrough. The guiding portion is arranged on the surrounding portion to guide the liquid stopped by the surrounding portion to flow away from the electrical line.

In a preferred embodiment, the guiding portion includes a plurality of tooth members of pyramid shapes, and the surrounding portion includes a flexible belt and engaging means connected to the flexible belt. The guiding portion is arranged on a first side of the flexible belt. The engaging means holds a first and a second ends of the flexible belt together to make a second side of the flexible belt opposite to the first side in close contact with the wire wrapper after the flexible belt is mounted around the wire wrapper to become a sleeve. In order to achieve this purpose, the engaging means preferably includes an engaging ring connected to the first end of the flexible belt, and an engaging bump connected to the second end of the flexible belt. The engaging bump is made of a flexible material. It penetrates through the engaging ring and sustains against a surface of the engaging ring to maintain the flexible belt as the sleeve. Preferably, the engaging bump consists of a series of tooth members, and one of the tooth members is selected to sustain against the surface of the engaging ring according to the circumference of the wire wrapper. Each of the tooth members is preferably a triangular cubic. In other words, a side view of each of the tooth members has a shape of a right-angled triangle.

Preferably, the surrounding portion further includes a filling bump which has a surface complying with a curve of the wire wrapper, and is arranged on the second side of the flexible belt at the first end in order to fill up a space between the flexible belt and the wire wrapper after the flexible belt is mounted around the wire wrapper.

The liquid-insulating device consisting of the above elements can be integrally formed.

According to a second aspect of the present invention, a method is provided for preventing liquid from entering an equipment to be protected along a connecting line. The method includes a step of surrounding a section of the connecting line with at least one liquid-proof sleeve, wherein the liquid-proof sleeve has an inner surface surrounding an outer surface of the connecting line relatively tightly, and a side area relatively large enough to stop the liquid from crossing thereover.

Preferably, the method further includes a step of guiding the liquid stopped by the side area of the liquid-proof sleeve to flow away from the connecting line.

More preferably, the method further includes a step of enclosing the equipment with a liquid-proof wrapper to further protect the equipment. In this case, two liquid-proofing sleeves located by two sides of the connector are used to tighten two ends of the liquid-proofing wrapper to be in close contact with the connecting line, respectively.

The liquid-proof sleeve used in the method according to the present invention can be detached from the connecting line or formed as a part of the connecting line. On the other hand, the liquid-proof sleeve can be integrally formed.

In a preferred embodiment where the liquid-proof sleeve is detachable from the connecting line, the guiding portion includes a plurality of tooth members having relatively sharp peaks, and the surrounding portion includes a flexible belt, an engaging ring, an engaging bump, and a filling bump. The guiding portion is arranged on the flexible belt. The flexible belt is made of a liquid-proof material, and includes the inner surface and the side area having functions mentioned above. The engaging ring is connected to a first end of the flexible belt. The engaging bump is made of a flexible material and connected to a second end of the flexible belt. After the flexible belt surrounds the connecting line, the engaging bump penetrates through the engaging ring and sustains against a surface of the engaging ring to maintain the flexible belt as a sleeve, and tightens the flexible belt to be in close contact with the connecting line. The filling bump is arranged on the flexible belt and has a surface complying with a curve of the connecting line in order to fill up a space between the flexible belt and the connecting line after the flexible belt surrounds the connecting line. Preferably, the engaging bump consists of a series of tooth members, and one of the tooth members is selected to sustain against the surface of the engaging ring according to the circumference of the connecting line. Each of the tooth members is preferably a triangular cubic. In other words, a side view of each of the tooth members has a shape of a right-angled triangle.

In another embodiment where the liquid-proof sleeve is formed as a part of the connecting line, the liquid-proof sleeve includes a surrounding sleeve and a plurality of tooth members. The surrounding sleeve is made of a liquid-proof material, and includes the inner surface and the side area having functions mentioned above. The plurality of tooth members are arranged on the surrounding sleeve and have relatively sharp peaks for guiding the liquid stopped by the side area to flow toward the peaks and further flow away from the connecting line.

According to the method of the present invention, the liquid-proof sleeve for example can be applied to a section of an electrical line adjacent to a connector to protect the connector. In this case, it is preferred to arrange at least two liquid-proofing sleeves respectively located by two sides of the connector.

On the other hand, the liquid-proof sleeve for example can also be applied to a section of a pipe line adjacent to a machine to protect the machine.

Of course, a plurality of the liquid-proof sleeves can be used to multiply the protecting effect.

According to a third aspect of the present invention, a device is provided for preventing liquid from entering a connector to be protected along an electrical line. The device includes a liquid-proof wrapper and four liquid-proof sleeves. The liquid-proof wrapper encloses the connector for protecting the connector. Two of the liquid-proof sleeves are mounted around the electrical line by two sides of the connector for tightening two ends of the liquid-proofing wrapper, respectively. The other two liquid-proof sleeves are mounted around the electrical line by two sides of the liquid-proof wrapper for stopping liquid from flowing into the liquid-proof wrapper.

BRIEF DESCRIPTION OF THE DRAWINGS

The present invention may best be understood through the following description with reference to the accompanying drawings, in which.

DETAILED DESCRIPTION OF THE PREFERRED EMBODIMENT

Figure 1A:
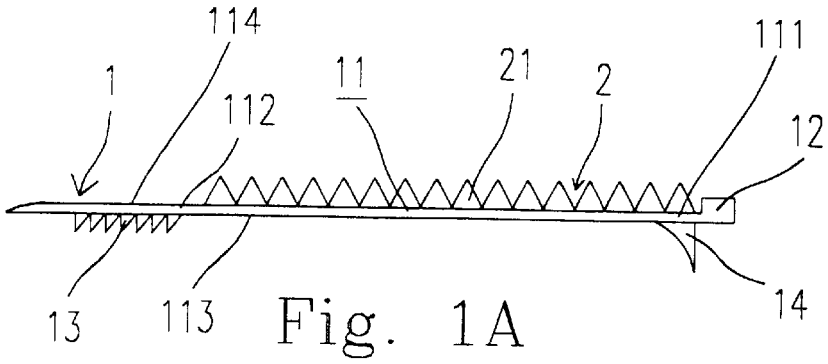
FIG. 1A is a side elevational view of a preferred embodiment of a liquid-insulating device according to the present invention.
Figure 1B:
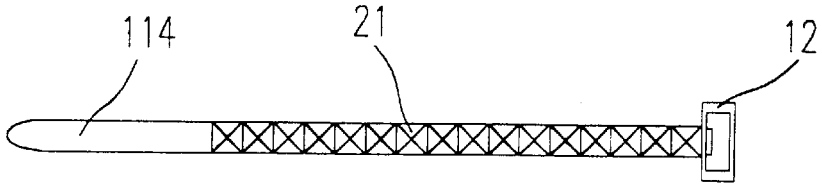
FIG. 1B is a top plane view of the liquid-insulating device of FIG. 1A.
Figure 1C:
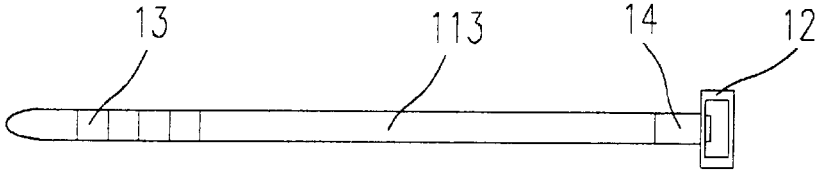
FIG. 1C is a bottom plane view of the liquid-insulating device of FIG. 1A.
Figure 1D:
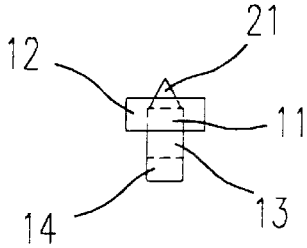
FIG. 1D is a front view of the liquid-insulating device of FIG. 1A.

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Please refer to FIGS. 1A~1D in which a preferred embodiment of a liquid-insulating device according to the present invention is schematically shown. The liquid-insulating device in the embodiment is integrally formed and distinguished as a surrounding portion 1 and a guiding portion 2. The surrounding portion 1 has structures of a flexible belt 11, an engaging ring 12 connected to one end 111 of the belt 11, a series of engaging teeth 13 arranged on the other end 112 of the belt 11, and a filling bump 14 located at the end 111 of the belt 11. The engaging teeth 13 and the filling bump 14 are both arranged on the bottom surface 113 of the belt 11. The guiding portion 2 consists of a plurality of tooth members 21 of pyramid shapes located on the top surface 114 of the belt 11. The application of the liquid-insulating device as mentioned above will be illustrated as follows with reference to FIGS. 2 and 3.

Figure 2:
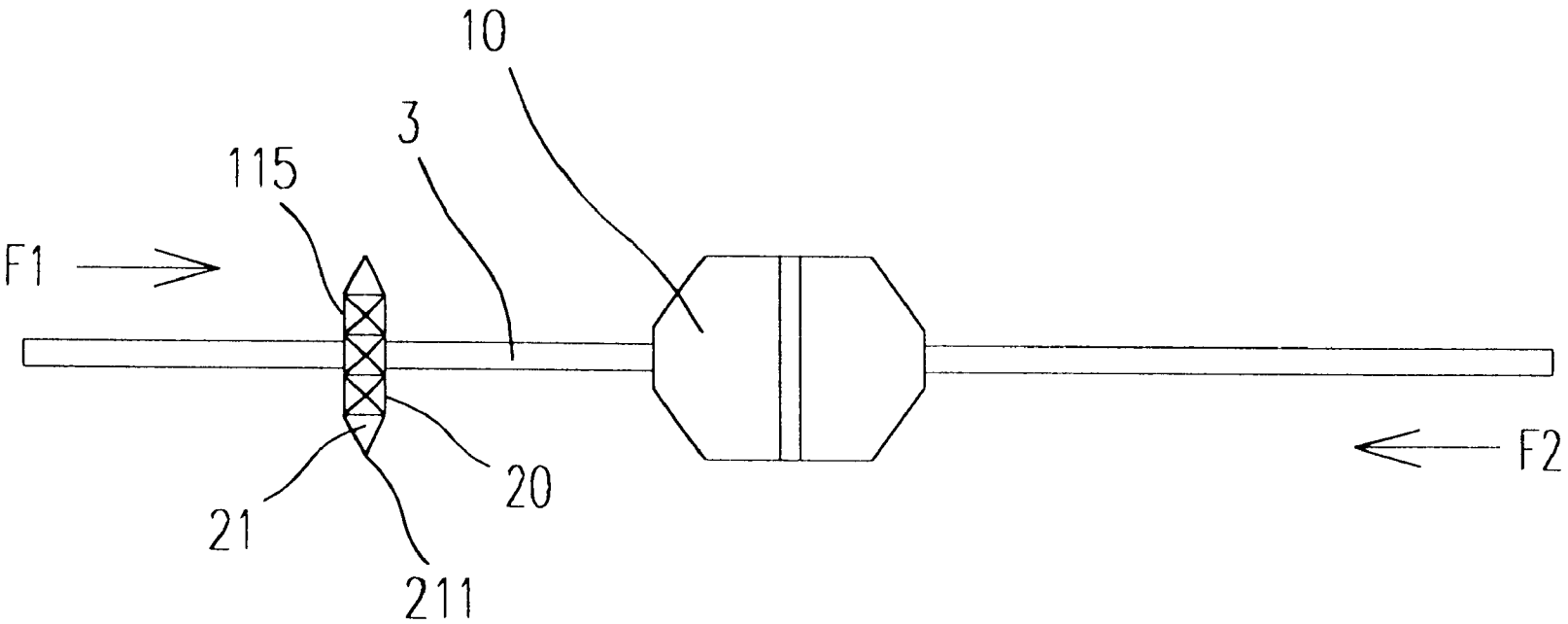
FIG. 2 is a schematic diagram showing the utilization of the liquid-insulating device of FIG. 1A to protect a connector.

FIG. 2 schematically shows that the liquid-insulating device 20 is applied to an electrical line 3 of a connector 10 to stop liquid from entering the connector 10 along the electrical line 3. The liquid flowing in the direction F1 is stopped by the side surface 201 of the liquid-insulating device 20, and then guided away by the tooth members 21 from the peaks 211. Thereby, the connector 10 can be protected from the contamination of the liquid. It is to be noted that the area of the side surface 115 which is proportional to the thickness of the belt 11 is not particularly limited as long as it is large enough to stop the liquid from crossing over the present liquid-insulating device 20 to reach the connector 10. On the other hand, in order to further stop liquid which may flow into the connector along the electrical line 3 in the direction F2, another liquid-insulating device can be provided by the other side of the connector 10 opposite to the one as shown. If desired, a plurality of the liquid-insulating devices can be applied to the electrical line at any proper positions to improve the liquid insulation effect.

Figure 3:
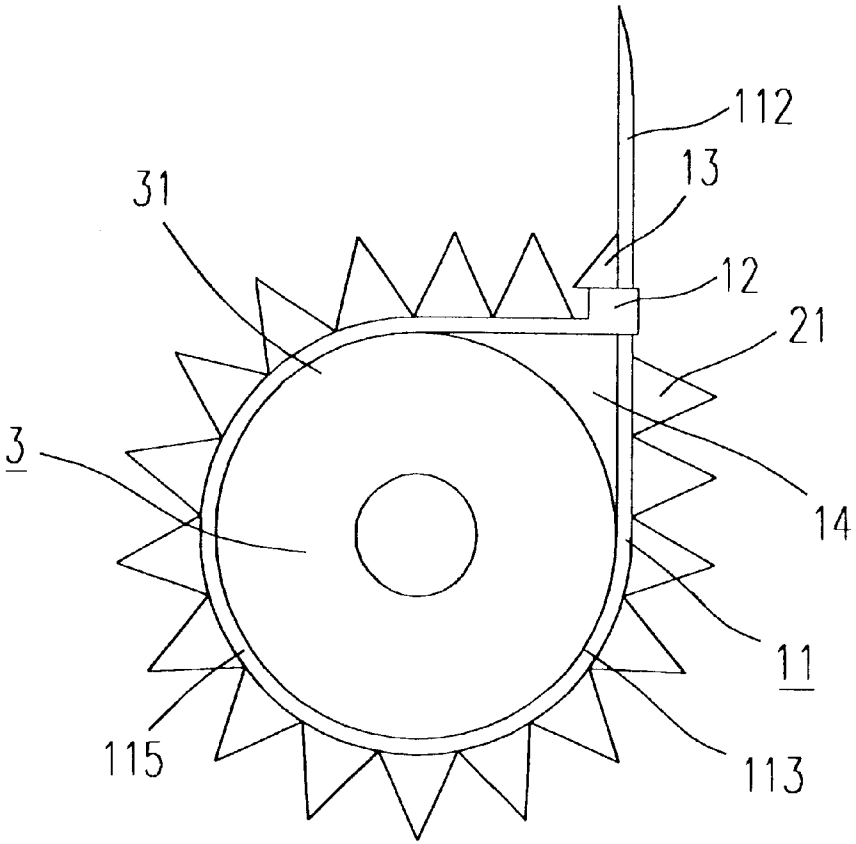
FIG. 3 is a schematic cross-sectional view showing the mounting of the liquid-insulating device of FIG. 1A around an electrical line of the connector.

FIG. 3 schematically shows the mounting details of the liquid-insulating device 20 of FIG. 2 around the electrical line 3. The flexible belt 11 surrounds the electrical line 3 to form a sleeve, and then the end 112 of the belt 11 is inserted into and penetrates through the engaging ring 12. One of the engaging teeth 13 is selected to sustain against the upper surface of the ring 12 according to the circumference of the electrical line 3 to keep the sleeve stable and assure of the close contact of the inner surface (i.e. the bottom surface 113 in FIG. 1) of the flexible belt 11 with the outer surface of the wire wrapper 31 of the electrical line 3. The presence of the filling bump 14 is for exempting from the undesired vacant space between the belt 11 and the electrical line 3 at the junction of the two ends of the belt 11. Therefore, the filling bump 14 preferably has a surface complying with the curve of the electrical line to assure of the filling effect.

While the engaging teeth 13 are arranged on the bottom surface 113 of the belt 11 in the embodiment illustrated above, they can also be arranged on the top surface 114 of the belt 11, or both, as long as the purpose for holding the sleeve can be achieved. Although the number, clearances, shapes and positions of the guiding teeth 21 are not particularly limited, a relatively large density is good and a relatively sharp peak is preferred for liquid guiding. If the liquid-guiding teeth 21 are designed to be similar to the engaging teeth 13, a part of the liquid-guiding teeth 21 can serve as the engaging teeth 13.

Figure 4:
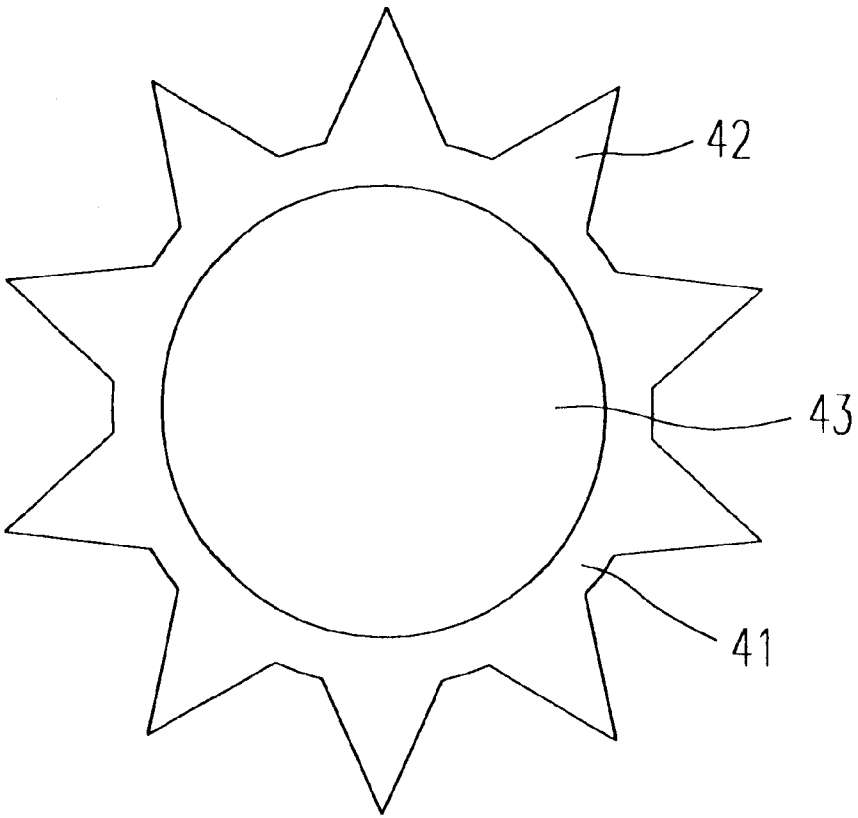
FIG. 4 is a schematic cross-sectional view showing an integrated sleeve type of liquid-insulating device according to the present invention, which is mounted around an electrical line of the connector.

Another preferred embodiment is shown in FIG. 4 in which a surrounding sleeve 41 having guiding teeth 42 thereon is directly sleeved around the electrical instead of mounting through engaging means to connect two ends of the belt as described above. Preferably, the surrounding sleeve is formed as a part of the electrical line 43 for example by injection molding.

Figure 5:
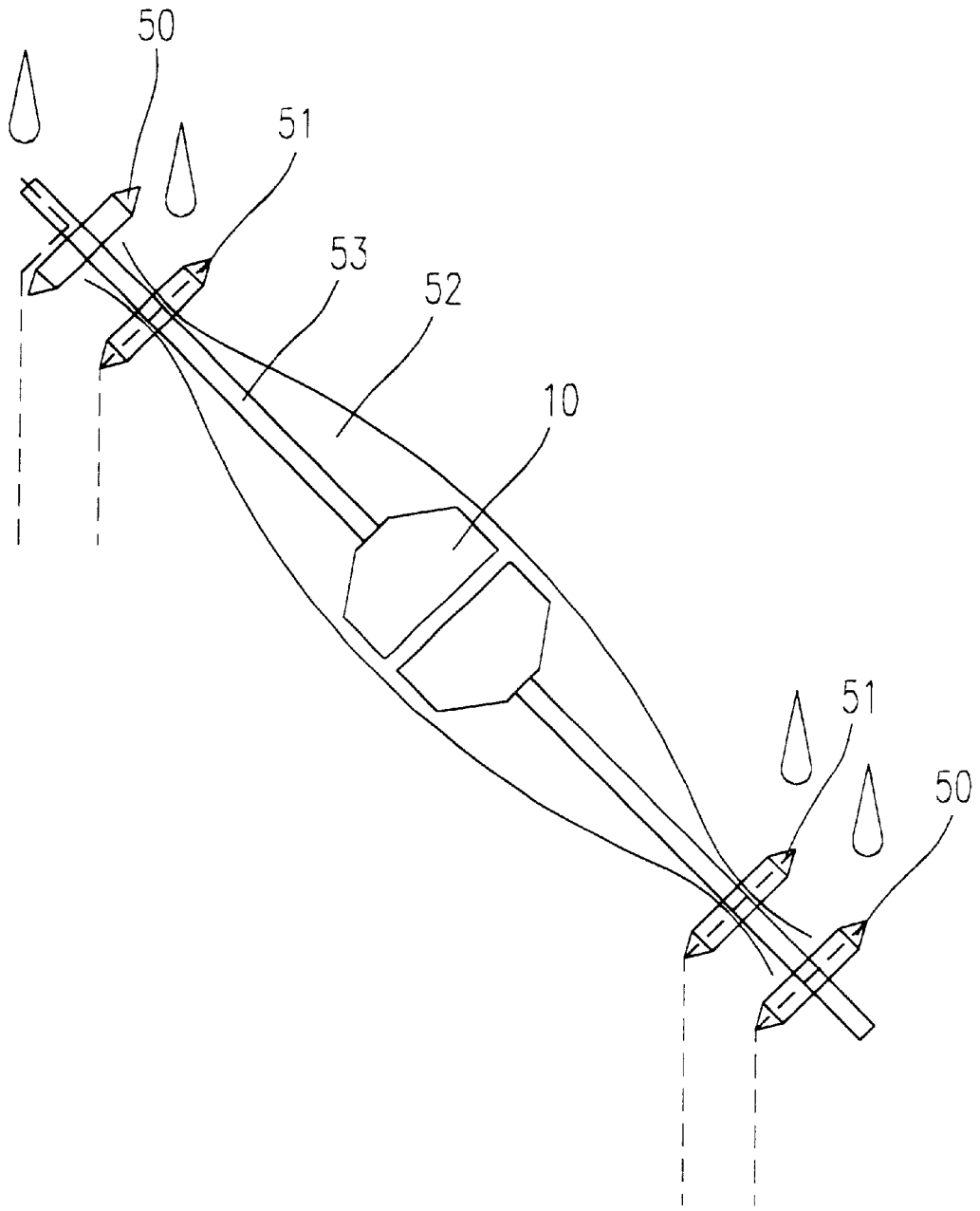
FIG. 5 is a schematic diagram showing the combination of liquid-insulating devices with a liquid-proof wrapper to provide a device for preventing liquid from entering a connector to be protected along an electrical line.

An additional use of a liquid-insulating device according to the present invention is to cooperate with a liquid-proof wrapper to further protect equipment from seeping liquid, especially when the electrical line is relatively slant, and the seeping liquid drops to the electrical line at various locations. Please refer to FIG. 5 which schematically shows the combination of four liquid-insulating devices 50, 51 and a liquid-proof wrapper 52 to provide a device for preventing liquid from entering a connector 10 to be protected along an electrical line 53. The liquid-proof wrapper 52 encloses the connector 10 for protecting the connector 10. Two liquid-proof sleeves 51 are mounted around the electrical line 53 beside the connector 10 for tightening two ends of the liquid-proofing wrapper 52, respectively, in addition to stopping liquid. The other two liquid-proof sleeves 50 are mounted around the electrical line 53 beside the liquid-proof wrapper 52 for stopping liquid from flowing into the liquid-proof wrapper. The liquid-proof sleeve 50 can be any one of the embodiments described above or alternatives, and is preferably arranged thereon guiding teeth as mentioned above for liquid guiding. The liquid-proof sleeve 51, however, should be separable from the electrical line 53 in order to secure the two ends of the wrapper 52 on the electrical line 53. Furthermore, it is to be understood that the number and positions of the liquid-proof sleeves 50 are not particularly limited, but depend on the liquid-seeping situations.

In addition to connectors or other electronic devices, the liquid-insulating device according to the present invention can be applied to any electrical apparatus, the connecting line of which extends from outdoors such as a cable line of television and a telephone line.

In addition to an electrical line, seeping liquid may flow toward the equipment along another type of medium such as a pipe line. Therefore, the liquid-insulating device according to the present invention can also be mounted around a pipe line connected to the equipment to be protected.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similarstructures.

What is claimed is:

1. A liquid-insulating device to be mounted around an electrical line of equipment to avoid liquid entering said equipment along said electrical line, comprising:

a flexible belt made of a liquid-proof material to be mounted around a wire wrapper of said electrical line;

a filling bump arranged on an inner side of said flexible belt at a first end of said flexible belt in order to fill up a space between said flexible belt and said wire wrapper after said flexible belt is mounted around said wire wrapper; and a guiding portion arranged on an outer side of said flexible belt opposite to said inner side to guide said liquid stopped by said flexible belt.

2. The liquid-insulating device according to claim 1 further comprising engaging means connected to said flexible belt for holding said first end and a second end of said flexible belt together in order to make said inner side of said flexible belt in close contact with said wire wrapper after said flexible belt is mounted around said wire wrapper to become a sleeve.

3. The liquid-insulating device according to claim 2 wherein said engaging means includes:

an engaging ring connected to said first end of said flexible belt; and an engaging bump made of a flexible material and connected to said second end of said flexible belt, said engaging bump penetrating through said engaging ring and sustaining against a surface of said engaging ring to maintain said flexible belt as said sleeve.

4. The liquid-insulating device according to claim 3 wherein said engaging bump consists of a series of tooth members, and one of said tooth members is selected to sustain against said surface of said engaging ring according to the circumference of said wire wrapper.

5. The liquid-insulating device according to claim 4 wherein a side view of each of said tooth members has a shape of a right-angled triangle.

6. The liquid-insulating device according to claim 1 wherein said guiding portion includes a plurality of tooth members of pyramid shapes.

7. The liquid-insulating device according to claim 6 being integrally formed.

8. A method for preventing liquid from entering an equipment to be protected along a connecting line, comprising the steps of:

surrounding a section of said connecting line with at least one liquid-proof sleeve which has an inner surface surrounding an outer surface of said connecting line relatively tightly, and a side area relatively large enough to stop said liquid from crossing thereover; and guiding said stopped liquid to flow away from said connecting line, wherein said liquid-proof sleeve comprises a surrounding sleeve made of a liquid-proof material and including said inner surface and said side area, and a plurality of tooth members arranged on said surrounding sleeve and having relatively sharp peaks for guiding said stopped liquid to flow toward said peaks and further flow away from said connecting line.

9. The method according to claim 8 wherein said liquid-proof sleeve is detachable from said connecting line.

10. The method according to claim 9 wherein said liquid-proof sleeve includes:

a flexible belt made of a liquid-proof material, and including said inner surface and said side area;

engaging means mounted to said flexible belt for tightening said flexible belt after said flexible belt surrounds said connecting line;

a filling bump arranged on said flexible belt in order to fill up a space between said flexible belt and said connecting line after said flexible belt surrounds said connecting line; and a plurality of tooth members arranged on said flexible belt and having relatively sharp peaks for guiding said liquid stopped by said side area to flow toward said peaks and further flow away from said connecting line.

11. The method according to claim 10 wherein said engaging means includes:

an engaging ring connected to a first end of said flexible belt; and an engaging bump made of a flexible material an connected to a second end of said flexible belt, said engaging bump penetrating through said engaging ring and sustaining against a surface of said engaging ring to maintain said flexible belt as a sleeve.

12. The method according to claim 11 wherein said engaging bump consisting of a series of tooth members, and one of said tooth members is selected to sustain against said surface of said engaging ring according to the circumference of said connecting line.

13. The method according to claim 12 wherein said liquid-proof sleeve is integrally formed.

14. The method according to claim 8 wherein said surrounding sleeve is formed as a part of said connecting line.

15. The method according to claim 8 wherein said connecting line is an electrical line.

16. The method according to claim 15 wherein said equipment is a connector.

17. The method according to claim 16 wherein said section of said connecting line is the section of said electrical line adjacent to said connector.

18. The method according to claim 17 wherein at least two liquid-proofing sleeves are used to be respectively located by two sides of said connector.

19. The method according to claim 18 for preventing liquid from entering an equipment enclosed with a liquid-proof wrapper by tightening two ends of said liquid-proof wrapper with said two liquid-proof sleeves located by two sides of said connector, respectively.

20. The method according to claim 8 wherein said connecting line is a pipe line.

21. The method according to claim 8 wherein a plurality of liquid-proof sleeves are used.

22. A device for preventing liquid from entering a connector to be protected along an electrical line, comprising:

a liquid-proof wrapper for enclosing said connector to protect said connector;

two first liquid-proof sleeves mounted around said electrical line for tightening two ends of said liquid-proofing wrapper, respectively; and two second liquid-proof sleeves mounted around said electrical line beside said liquid-proof wrapper for stopping liquid from flowing into said liquid-proof wrapper.

* * * * *